US010907832B2

(12) United States Patent
Zajadatz et al.

(10) Patent No.: US 10,907,832 B2
(45) Date of Patent: Feb. 2, 2021

(54) PILOT NOZZLE TIPS FOR EXTENDED LANCE OF COMBUSTOR BURNER

(71) Applicant: General Electric Company, Schenectady, NY (US)

(72) Inventors: Martin Zajadatz, Kussaberg (DE); Ewald Freitag, Boppelsen (CH); Fulvio Magni, Nussbaumen (CH)

(73) Assignee: General Electric Company, Schenectady, NY (US)

( * ) Notice: Subject to any disclaimer, the term of this patent is extended or adjusted under 35 U.S.C. 154(b) by 379 days.

(21) Appl. No.: 16/003,819

(22) Filed: Jun. 8, 2018

(65) Prior Publication Data

US 2019/0376691 A1 Dec. 12, 2019

(51) Int. Cl.

| | |
|---|---|
| ***F23R 3/36*** | (2006.01) |
| ***F23R 3/14*** | (2006.01) |
| ***F23R 3/34*** | (2006.01) |
| ***F23D 17/00*** | (2006.01) |
| ***F23R 3/28*** | (2006.01) |

(52) U.S. Cl.

CPC ..... *F23R 3/343* (2013.01); *F23D 17/002* (2013.01); *F23R 3/14* (2013.01); *F23R 3/286* (2013.01); *F23R 3/36* (2013.01)

(58) Field of Classification Search

CPC .. F23R 3/14; F23R 3/283; F23R 3/286; F23R 3/343; F23R 3/36; F23D 17/002

See application file for complete search history.

(56) References Cited

U.S. PATENT DOCUMENTS

| | | | | |
|---|---|---|---|---|
| 6,045,351 | A | 4/2000 | Dobbeling et al. | |
| 8,033,821 | B2 | 10/2011 | Eroglu | |
| 8,057,224 | B2 | 11/2011 | Knoepfel | |
| 8,069,671 | B2 | 12/2011 | Hellat et al. | |
| 8,601,818 | B2 | 12/2013 | Eroglu | |
| 9,103,547 | B2 | 8/2015 | Eroglu et al. | |
| 9,664,393 | B2 | 5/2017 | Andersson et al. | |
| 2006/0080966 | A1* | 4/2006 | Widener | F02C 3/20 60/775 |
| 2007/0231762 | A1* | 10/2007 | Bernero | F23R 3/286 431/350 |
| 2010/0175382 | A1* | 7/2010 | Eroglu | F23R 3/34 60/748 |
| 2017/0176000 | A1* | 6/2017 | Shershnyov | F23D 11/16 |

* cited by examiner

*Primary Examiner* — Gerald L Sung
*Assistant Examiner* — Alyson Joan Harrington
(74) *Attorney, Agent, or Firm* — Charlotte C. Wilson; James W. Pemrick

(57) ABSTRACT

A burner for a combustor includes (a) a swirl generator enclosing a burner interior on an inlet side and including a tangential air inlet relative to a longitudinal center axis; (b) a mixing chamber enclosing the burner interior on an outlet side and defining a burner outlet fluidly connecting the burner interior with a combustion chamber; and (c) a lance arranged coaxially with the longitudinal center axis. The lance introduces fuel through a nozzle tip at or near the burner outlet into the combustion chamber. The nozzle tip includes a cartridge defining a center fuel passage; fuel swirl vanes within the center fuel passage at an outlet end of the nozzle tip; a first tube surrounding the center fuel passage and defining a first fluid passage; a second tube surrounding the first tube and defining a second fluid passage; and air swirl vanes in the second fluid passage.

17 Claims, 14 Drawing Sheets

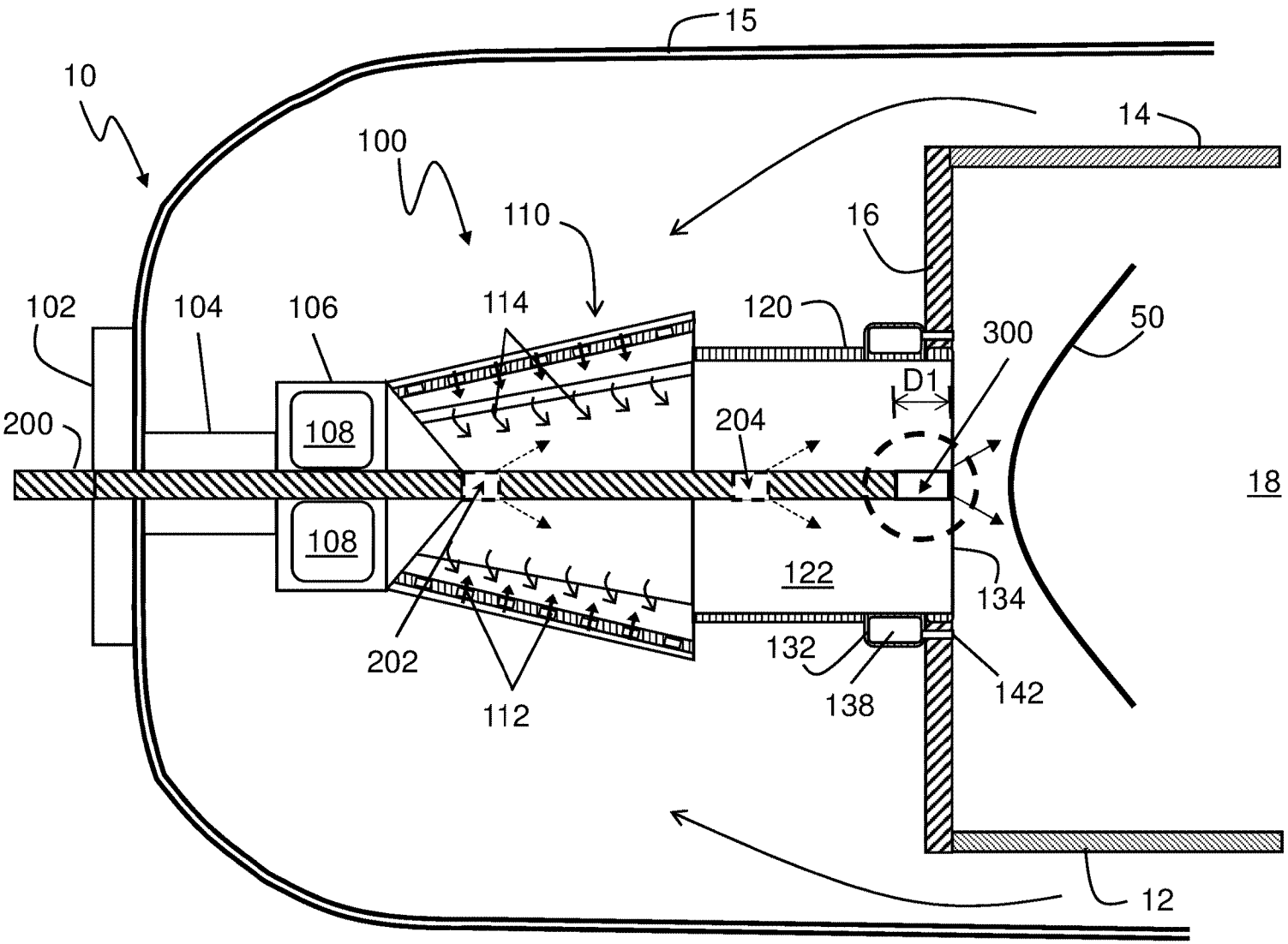
—FIG. 2—

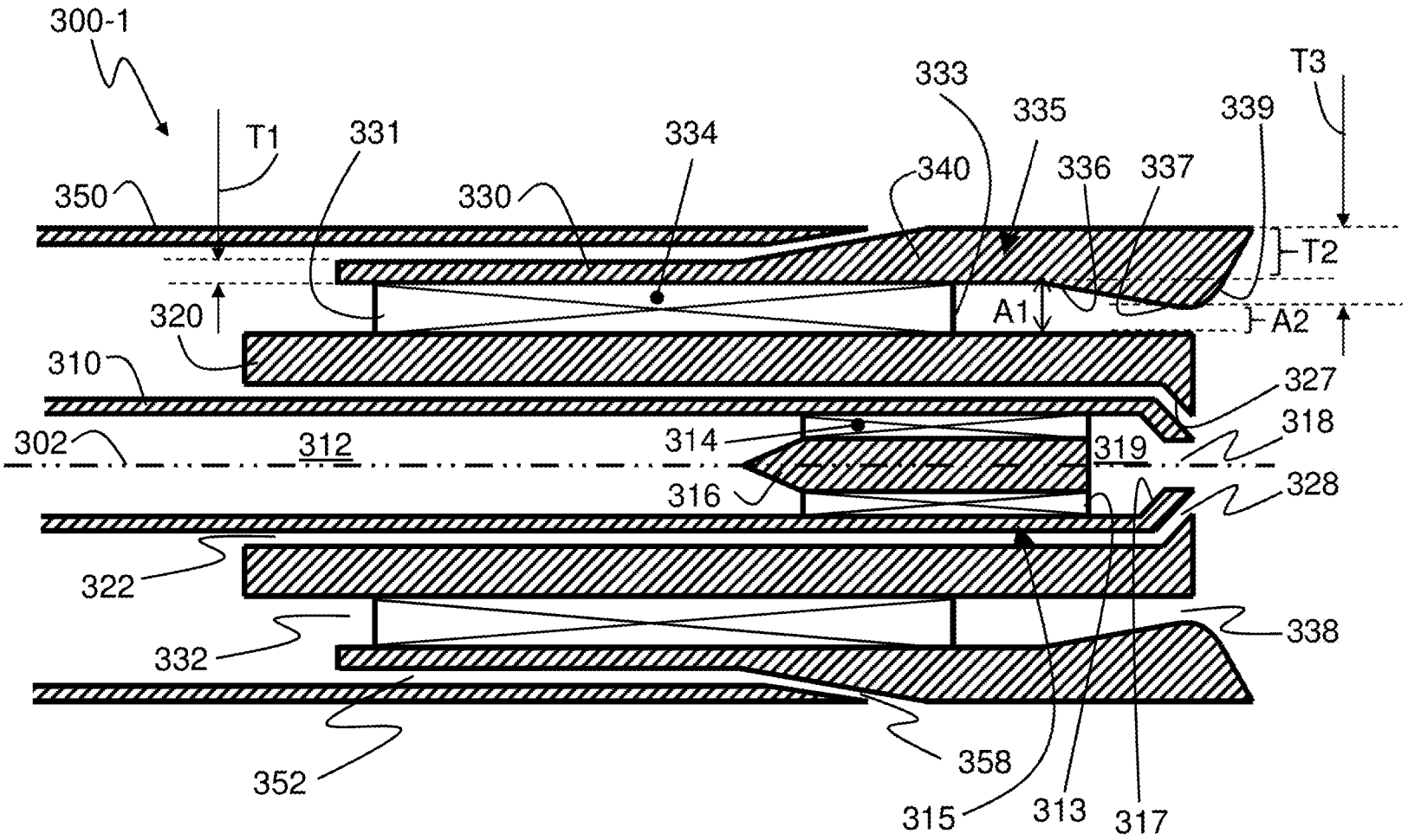
—FIG. 3—

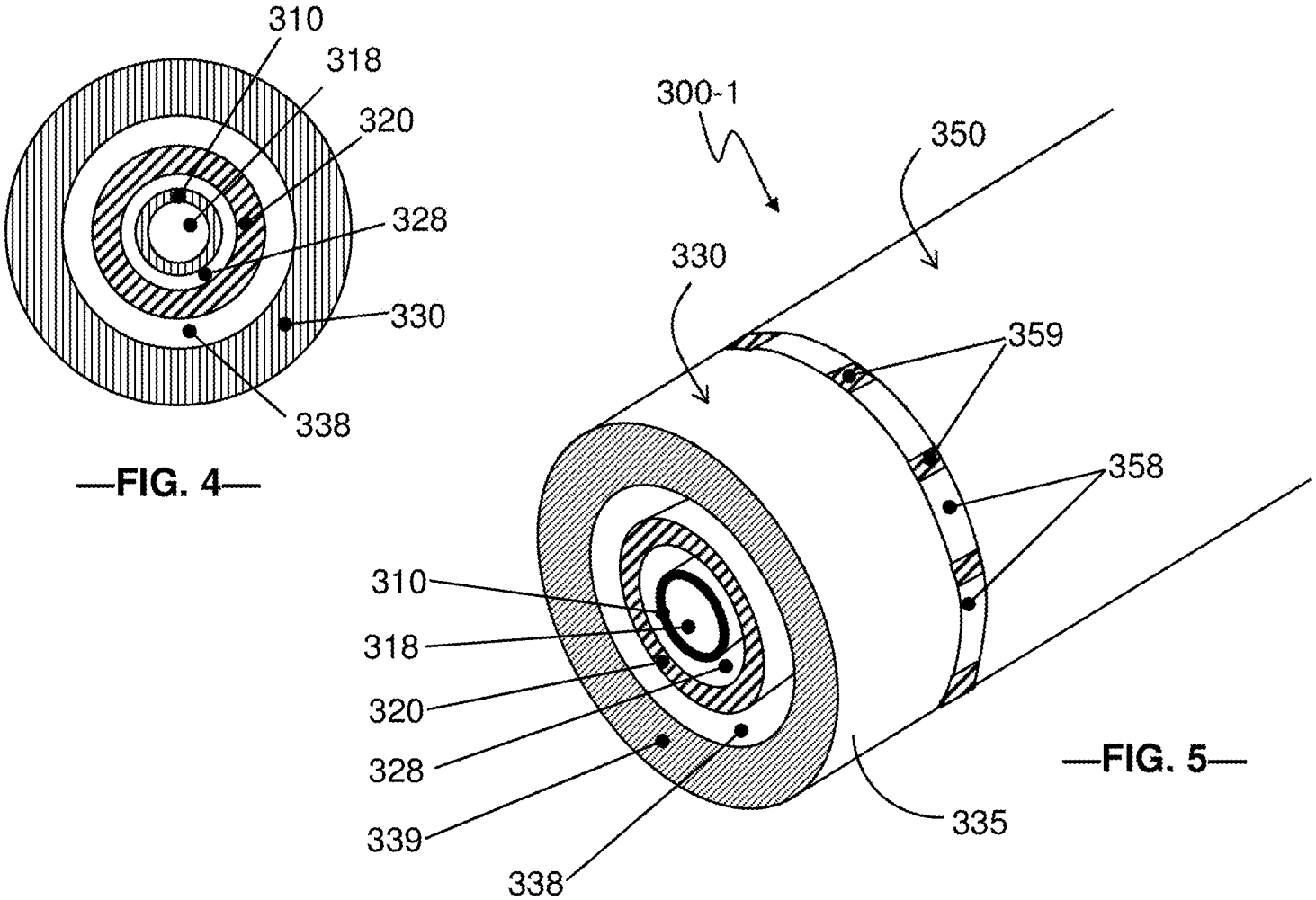
—FIG. 5—
—FIG. 4—

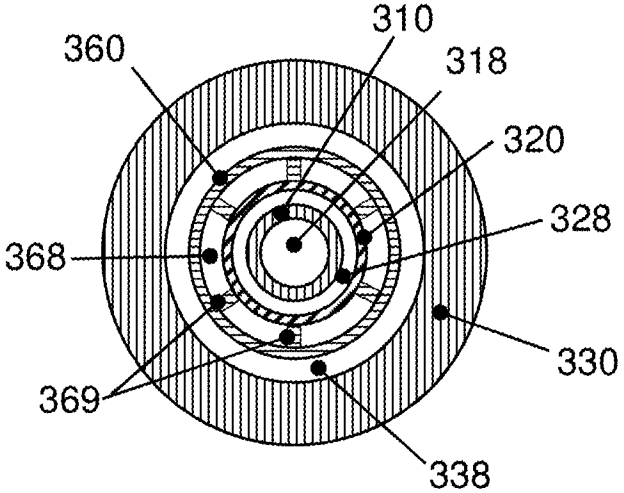
—FIG. 9—
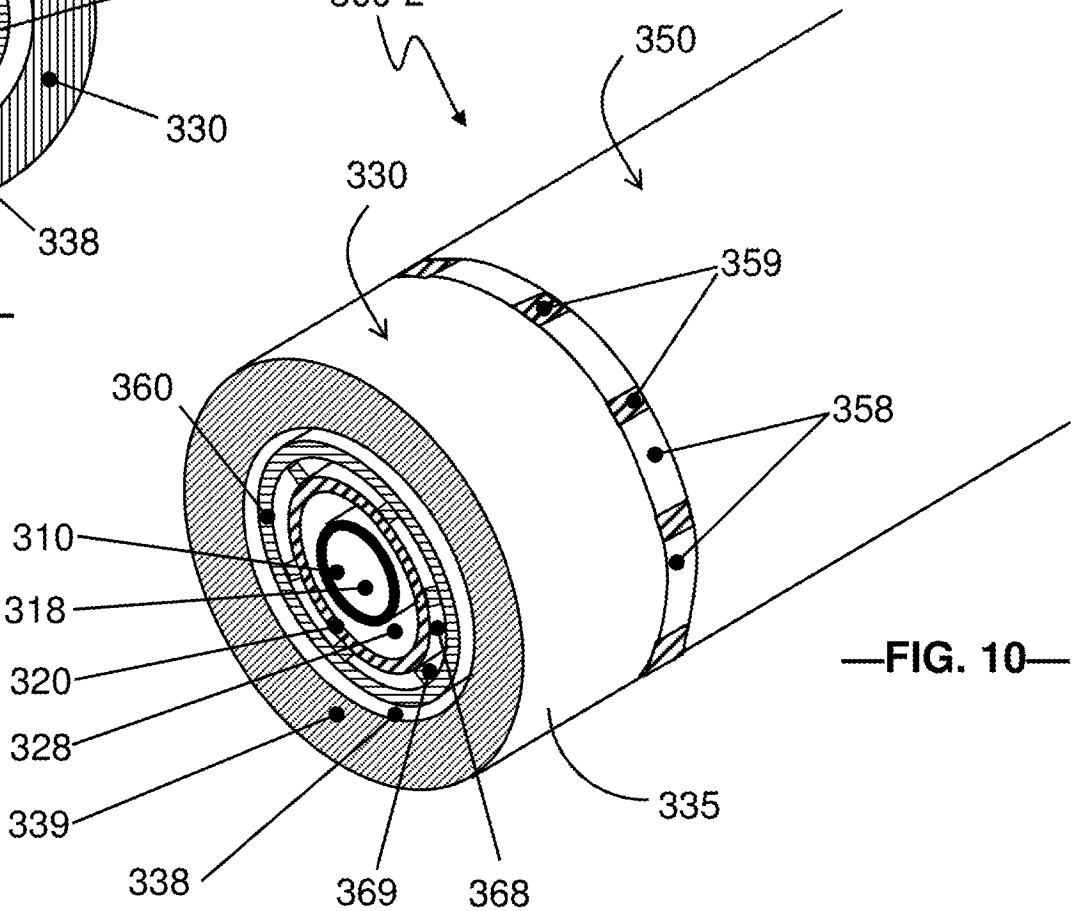
—FIG. 10—

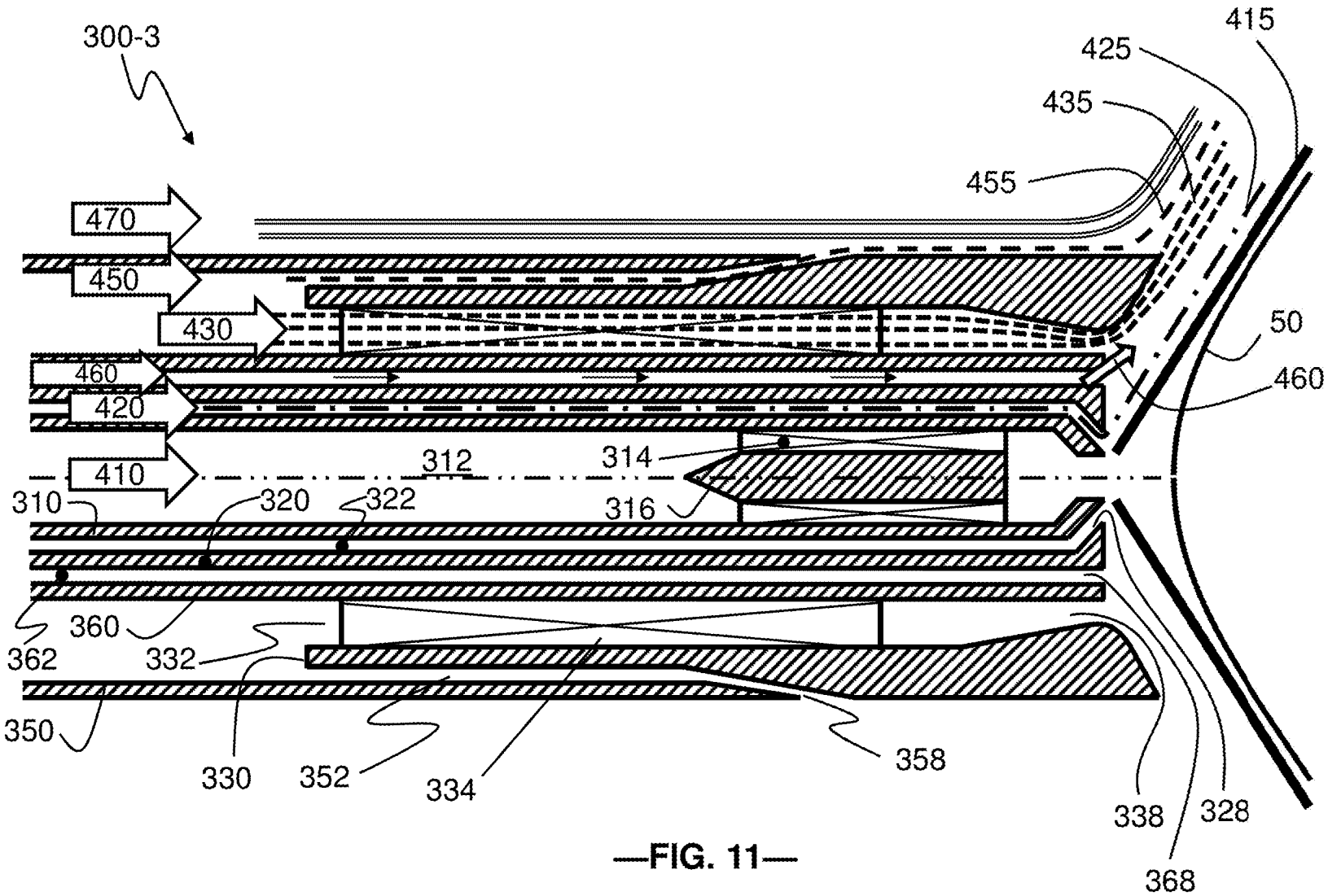
—FIG. 11—

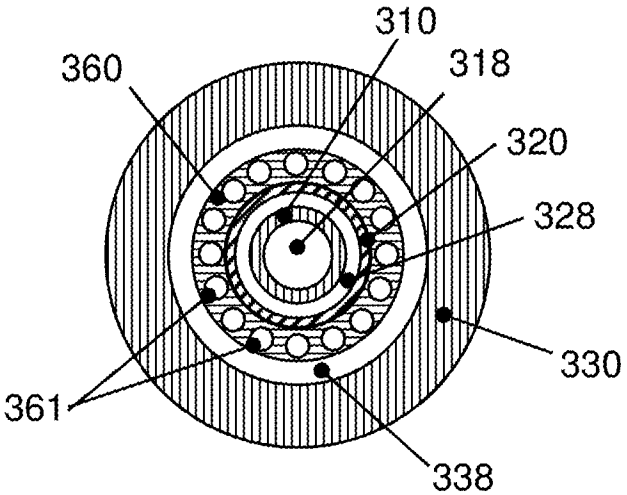
—FIG. 12—
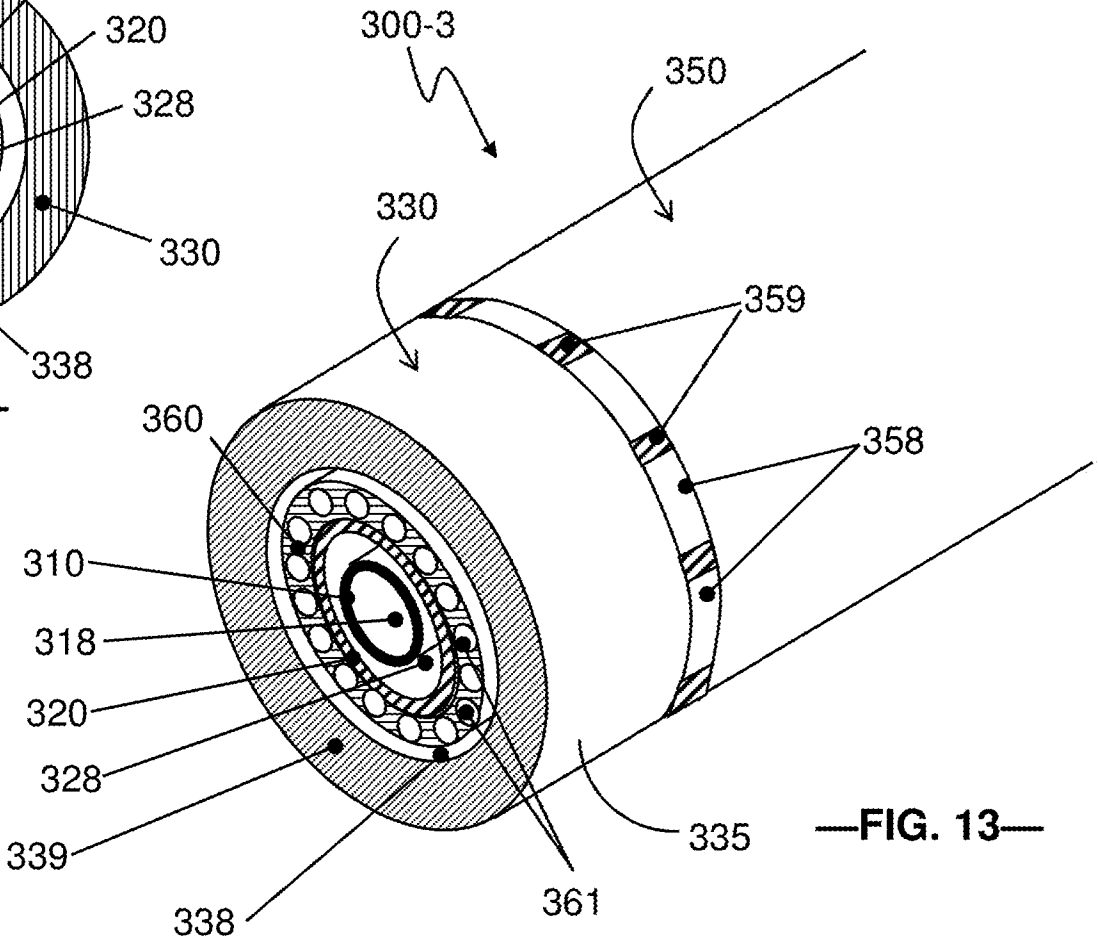
—FIG. 13—

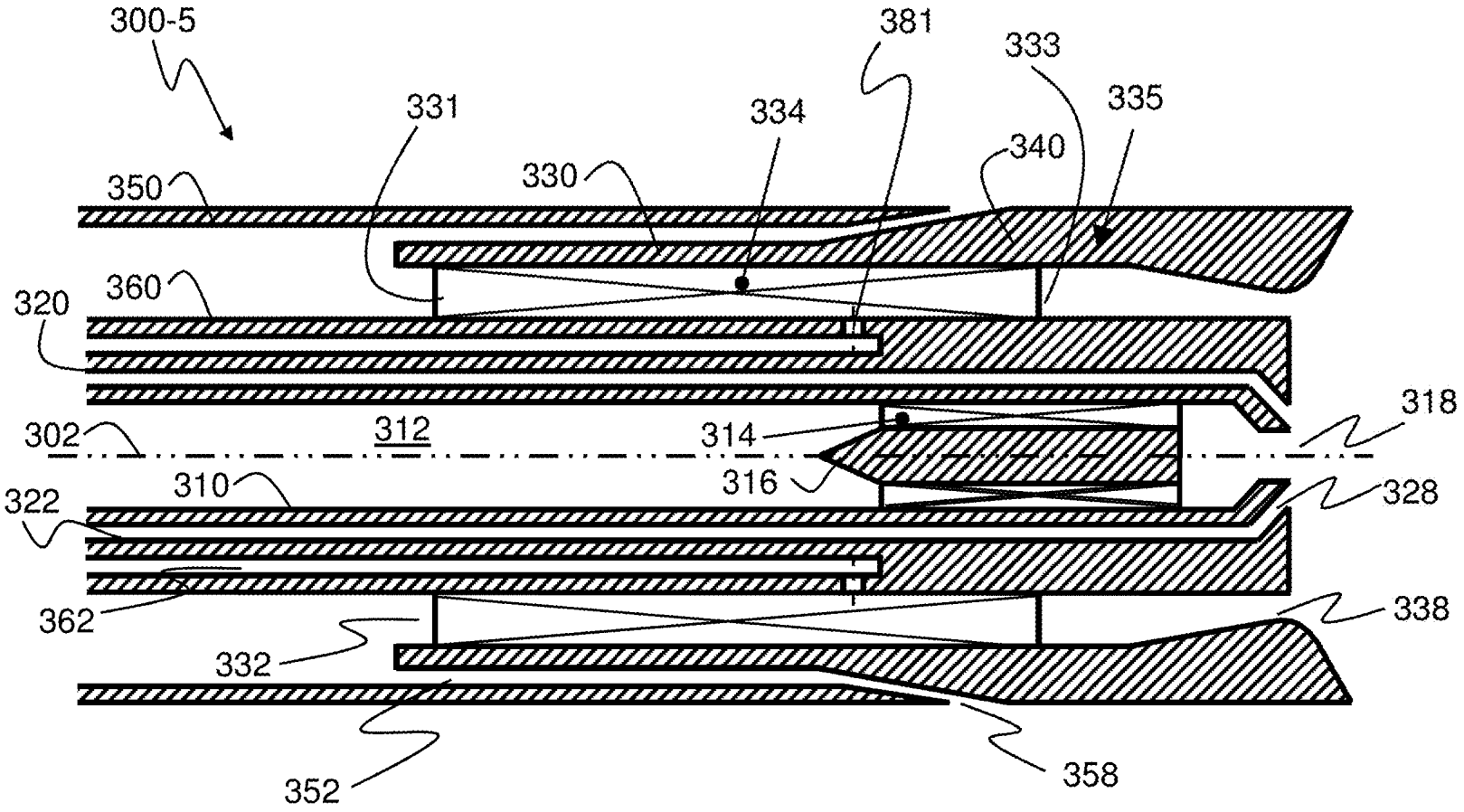
—FIG. 16—

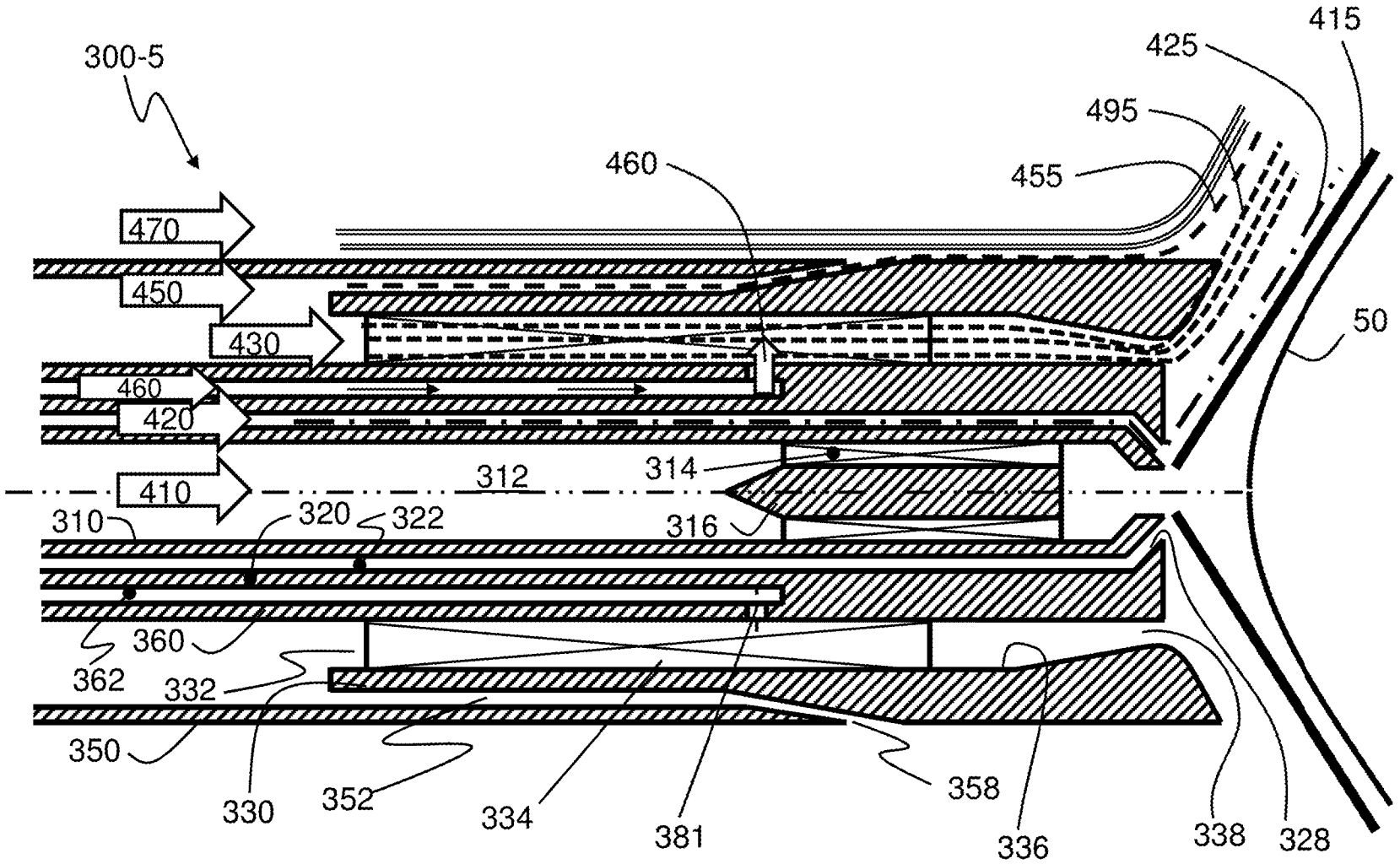
—FIG. 17—

PILOT NOZZLE TIPS FOR EXTENDED LANCE OF COMBUSTOR BURNER

TECHNICAL FIELD

The present disclosure relates to the field of combustion technology and, more particularly, to a burner for an annular combustor of a power-generating gas turbine. Specifically, the present disclosure is directed to nozzle tips for an extended lance of such a burner.

BACKGROUND

Burners for annular combustors often include a conical body with swirl-generating vanes, which impart a swirl, or tangential component, to the air flowing through the vanes; a mixing section downstream of the swirling vanes; and a pilot fuel assembly for introducing pilot fuel into the combustion chamber. The pilot fuel assembly includes a lance that extends coaxially along the longitudinal center axis of the burner from a burner head into the burner interior.

These burners generally operate in premixed mode or pilot mode, and operators often demand that the burners (including the pilot fuel assemblies) be equally capable of introducing liquid fuel, instead of the gaseous fuel, during some operating cycles to provide greater operational flexibility.

To reduce emissions, particularly of nitrous oxides, it is desirable to mix the fuel and air prior to its introduction into the annular combustion chamber (such mixing sometimes being referred to as "premixing"). In premixed mode, liquid fuel is introduced from a centrally located lance into the conical burner body, where air is introduced in a tangential direction to impart swirl and to promote mixing. The liquid fuel and air are further mixed in a tubular mixing section downstream of the conical nozzle body before being directed through the burner outlet into the combustion chamber. Alternately, when gaseous fuel is used, the gaseous fuel is directed through fuel inlets in the conical nozzle body, is mixed with air as the gaseous fuel is conveyed through the mixing section, and is injected through the burner outlet as a pre-mixture of fuel and air.

The pilot fuel assembly may be used for start-up and other operating modes, where flame stabilization may be beneficial. In the pilot mode, the liquid fuel (or gaseous fuel) is introduced by the fuel lance disposed along the longitudinal axis of the burner. The liquid fuel may be used as-is ("dry") or may be emulsified with water ("wet"). Historically, to provide sufficient time for evaporating the fuel and premixing the fuel and air, the outlet end of the fuel lance has been disposed upstream of the end of the burner. However, it has been found that, when burning some fuels—such as light crude oil, which needs more time to evaporate—the liquid fuel droplets tend to accumulate on the inner surfaces of the burner. Over time, the build-up of liquid fuel droplets ("coking") can induce flashback of the flame from the combustion chamber into the burner. As a result, the burner may be damaged, and operations may be interrupted.

Therefore, a burner having a pilot fuel assembly capable of operation with a wide range of fuels with minimal coking is desirable.

SUMMARY

A burner for a combustor is provided. According to one aspect of the present disclosure, the burner includes: (a) a swirl generator enclosing a burner interior on an inlet side, the swirl generator comprising at least one tangential air inlet relative to a longitudinal center axis of the burner; (b) a mixing chamber enclosing the burner interior on an outlet side, the mixing chamber defining a burner outlet fluidly connecting the burner interior with a combustion chamber of the combustor; and (c) a lance arranged coaxially with the longitudinal center axis of the burner and including a nozzle tip at or near the burner outlet. The nozzle tip is configured and arranged to introduce fuel into the combustion chamber. The nozzle tip includes a cartridge defining a center fuel passage; a first plurality of swirl vanes disposed within the center fuel passage at an outlet end of the nozzle tip; a first concentric tube surrounding the center fuel passage and defining a first annular fluid passage therebetween; a second concentric tube surrounding the first concentric tube and defining a second annular fluid passage; and a second plurality of swirl vanes disposed in the second annular fluid passage.

According to one aspect of the present disclosure, the burner includes: (a) a swirl generator enclosing a burner interior on an inlet side, the swirl generator comprising at least one tangential air inlet relative to a longitudinal center axis of the burner; (b) a mixing chamber enclosing the burner interior on an outlet side, the mixing chamber defining a burner outlet fluidly connecting the burner interior with a combustion chamber of the combustor; (c) a lance arranged coaxially with the longitudinal center axis of the burner, the lance comprising a nozzle tip at or near the burner outlet, the nozzle tip being configured and arranged to introduce fuel into the combustion chamber. The nozzle tip includes a cartridge defining a center fuel passage; a first plurality of swirl vanes disposed within the center fuel passage at an outlet end of the nozzle tip; a first concentric tube surrounding the center fuel passage and defining a first annular fluid passage therebetween; a second concentric tube surrounding the first concentric tube and defining a second annular fluid passage, the second concentric tube having a non-uniform thickness from an inlet end to an outlet end; a second plurality of swirl vanes disposed in the second annular fluid passage; a third concentric tube surrounding an upstream portion of the second concentric tube and defining a third annular fluid passage therebetween, the third concentric tube defining a plurality of air channels in fluid communication with the third annular fluid passage, the plurality of air channels being disposed between a downstream end of the third concentric tube and the second concentric tube; and a fourth concentric tube disposed between the first concentric tube and the second concentric tube, wherein a fourth annular fluid passage is defined between the first concentric tube and the fourth concentric tube.

BRIEF DESCRIPTION OF THE DRAWINGS

The specification, directed to one of ordinary skill in the art, sets forth a full and enabling disclosure of the present system and method, including the best mode of using the same. The specification refers to the appended figures, in which:

FIG. 2 is a schematic side view of one of the plurality of burners of FIG. 1;

FIG. 3 is a schematic cross-sectional side view of a nozzle tip of the burner lance of FIG. 2, which is designed for liquid fuel operation, according to one aspect provided herein;

FIG. 4 is a plan view of a downstream end of the nozzle tip of FIG. 3;

FIG. 5 is a perspective view of the nozzle tip of FIG. 3;

FIG. 9 is a plan view of a downstream end of the nozzle tip of FIG. 8;

FIG. 10 is a perspective view of the nozzle tip of FIG. 8;

FIG. 11 is a schematic cross-sectional side view of the nozzle tip of FIG. 8, in which various flow paths are illustrated;

FIG. 12 is a plan view of a downstream end of an alternate version of the nozzle tip of FIG. 8;

FIG. 13 is a perspective view of the alternate version of the nozzle tip, as shown in FIG. 12;

FIG. 16 is a schematic cross-sectional side view of a nozzle tip of the burner lance of FIG. 2, which is designed for liquid fuel operation and/or fully premixed gaseous fuel operation, according to a further aspect provided herein; and FIG. 17 is a schematic cross-sectional side view of the nozzle tip of FIG. 16, in which various flow paths are illustrated.

DETAILED DESCRIPTION

To clearly describe the current burners and their respective nozzle tips, certain terminology will be used to refer to and describe relevant machine components within the scope of this disclosure. To the extent possible, common industry terminology will be used and employed in a manner consistent with the accepted meaning of the terms. Unless otherwise stated, such terminology should be given a broad interpretation consistent with the context of the present application and the scope of the appended claims. Those of ordinary skill in the art will appreciate that often a particular component may be referred to using several different or overlapping terms. What may be described herein as being a single part may include and be referenced in another context as consisting of multiple components. Alternatively, what may be described herein as including multiple components may be referred to elsewhere as a single part.

In addition, several descriptive terms may be used regularly herein, as described below. As used herein, "downstream" and "upstream" are terms that indicate a direction relative to the flow of a fluid, such as the working fluid through the turbine engine. The term "downstream" corresponds to the direction of flow of the fluid, and the term "upstream" refers to the direction opposite to the flow (i.e., the direction from which the fluid flows). The terms "forward" and "aft," without any further specificity, refer to relative position, with "forward" being used to describe components or surfaces located toward the front (or compressor) end of the engine, and "aft" being used to describe components located toward the rearward (or turbine) end of the engine. Additionally, the terms "leading" and "trailing" may be used and/or understood as being similar in description as the terms "forward" and "aft," respectively. "Leading" may be used to describe, for example, a surface of a swirler vane over which a fluid initially flows, and "trailing" may be used to describe a surface of the swirler vane over which the fluid finally flows.

Figure 1:
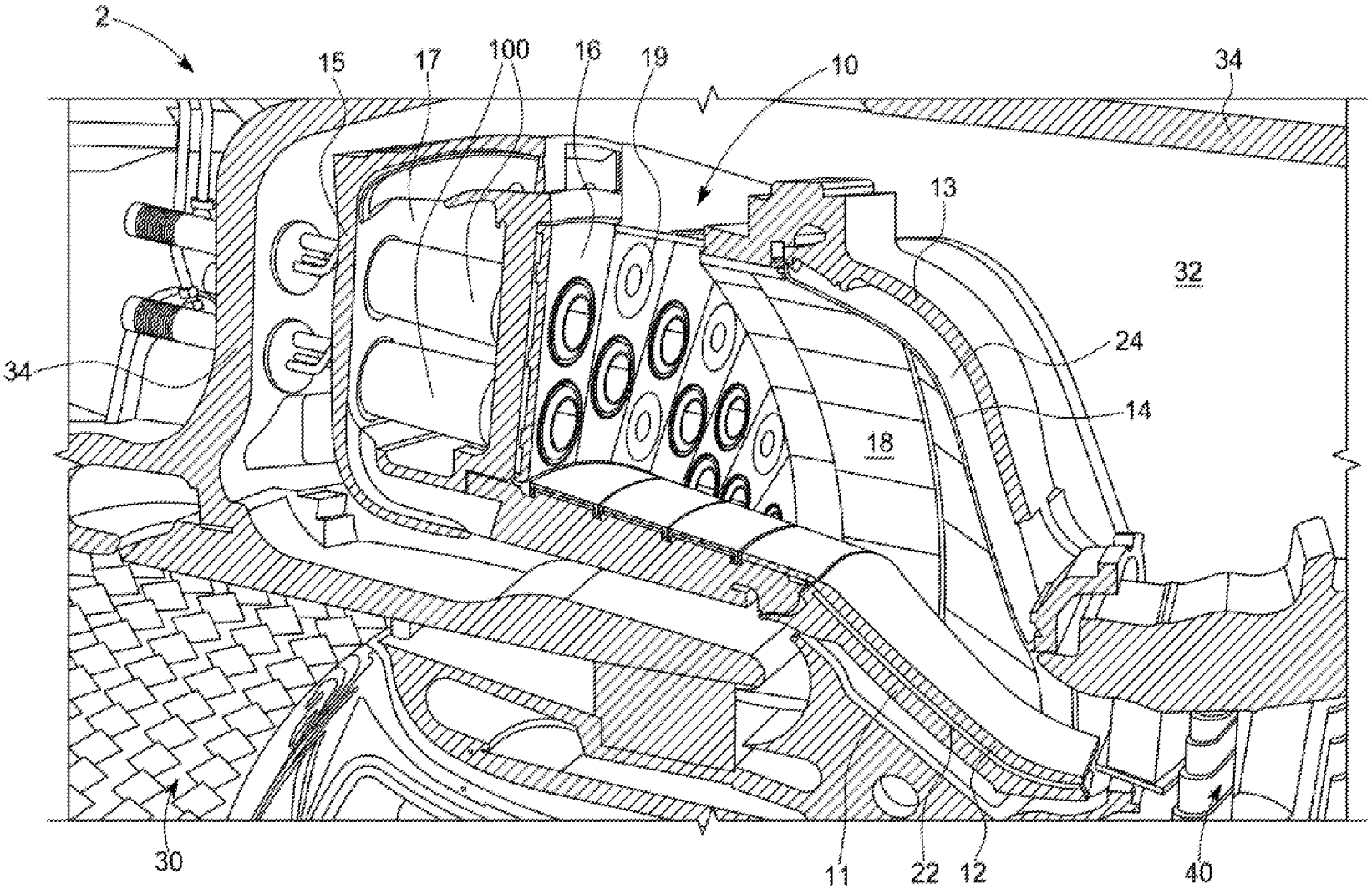
FIG. 1 is a sectional perspective view of an annular combustor with a plurality of burners, according to the present disclosure.

It is often required to describe parts that are at differing radial, axial and/or circumferential positions. As shown in FIG. 1, the "A" axis represents an axial orientation. As used herein, the terms "axial" and/or "axially" refer to the relative position/direction of objects along axis A, which is substantially parallel with the axis of rotation of the turbine system or the longitudinal axis of the annular combustor. As further used herein, the terms "radial" and/or "radially" refer to the relative position or direction of objects along an axis "R", which intersects axis A at only one location defining an angle that is typically perpendicular or substantially perpendicular to axis A. Finally, the term "circumferential" refers to movement or position around axis A (e.g., in a rotation "C"). The term "circumferential" may refer to a dimension extending around a center of any suitable shape (e.g., a polygon) and is not limited to a dimension extending around a center of a circular shape.

The present burner lances are extended toward the combustion chamber and include nozzle tips that swirl the liquid fuel before it is injected into the combustion chamber. The liquid fuel passage is surrounded by a purge air passage to reduce the likelihood of coking and to produce an air shield around the liquid fuel, as the liquid fuel is injected. Radially outward of the purge air passage, a main air passage includes an air swirler to swirl the flow of air therethrough. The main air passage is surrounded, at least partially along its axial length, by a film air cooling passage, which vents from ports around the sidewall of the nozzle tip.

FIG. 1 is sectional perspective view of a gas turbine 2 having an annular combustor 10, a compressor 30 supplying air to the annular combustor 10, and a turbine 40 driven by the combustion products produced by the annular combustor 10.

The annular combustor 10 includes a circumferential array of burner assemblies 100. The annular combustor 10 further includes an inner liner shell 12, an outer liner shell 14, and a front segment 16 through which the burner assemblies 100 extend. An annular combustion chamber 18 is defined between the inner liner shell 12 and the outer liner shell 14 and is bounded at the upstream end by the front segment 16. The downstream end of the annular combustor 10 is open to permit the flow of combustion gases into the turbine 30.

The inner liner shell 12 may be provided with a cooling sleeve 11 that circumferentially surrounds at least a portion of the axial length of the inner liner shell 12, such that an annulus 22 is defined between the cooling sleeve 11 and the inner liner shell 12. The outer liner shell 14 may be provided with a cooling sleeve 13 that circumferentially surrounds at least a portion of the axial length of the outer liner shell 14, such that an annulus 24 is defined between the cooling sleeve 13 and the outer liner shell 14. The upstream end of the combustor 10 may be provided with a dome 15, which creates a dome air plenum 17 upstream of the front segment 16.

In operation, air compressed by a compressor 30 is directed into a high-pressure air plenum 32 defined by a casing 34, which encloses the annular combustor 10. Air from the high-pressure air plenum 32 flows into the annulus 22 between the cooling sleeve 11 and the inner liner shell 12 to cool the inner liner shell 12. Likewise, air flows into the annulus 24 between the cooling sleeve 13 and the outer liner shell 14 to cool the outer liner shell 14. Air from the cooling annuli 22, 24 and/or from the casing plenum 32 is introduced into the dome air plenum 17, where the air is directed into the burners 100 to be introduced, with fuel from the fuel lance 200, into the combustion chamber 18. Some of the air streams may be conveyed through one or more dampers 19 disposed in the front segment 16 to reduce combustion dynamics.

FIG. 2 is a schematic illustration of a single burner 100 in the dome 15 of an annular combustor 10. The burner 100 includes an upstream mounting flange 102 that is attached to the dome 15 opposite the front segment 16. A fuel conduit 104 feeds a fuel manifold 106 that defines a fuel plenum 108. Fuel from the fuel plenum 108 is delivered through a plurality of fuel injection ports 112 defined along the walls of a conical swirl generator 110 in the direction of the in-flowing, swirling air 114, as described, for example, in U.S. Pat. No. 6,045,351 to Dobbeling et al. Air from the dome air plenum 17 is introduced tangentially into the conical swirl generator 110 to produce the swirling air flow 114. The fuel and air are mixed within a mixing chamber 122 defined by a mixing cylinder 120. The mixing chamber 122 extends through the mixing cylinder 120 and a downstream mounting flange 132 to a burner outlet 134.

In some instances, the downstream mounting flange 132 may function as a fuel manifold 138 for an externally supplied pilot fuel, via an auxiliary fuel conduit (not shown). The externally supplied pilot fuel, which is typically a gaseous fuel, is injected through multiple circumferentially distributed pilot gas ports 142.

Conventionally, in an exemplary burner of this type, a centrally located lance 200 terminates with a nozzle tip located at a first position at the upstream end of the conical swirl generator 110, as shown by the dashed lines 202. In yet another exemplary conventional burner, as described in U.S. Pat. No. 8,069,671 to Hellat et al., the lance 200 terminates with a nozzle tip at a second position within the mixing chamber 122, as shown by the dashed lines 204.

In the present embodiments, however, the lance 200 terminates with a nozzle tip 300 that is disposed at or near the burner outlet 134. The term "at" is intended to describe a position in which a downstream surface of the nozzle tip 300 is disposed in the same axial plane as the burner outlet 134, while the term "near" is intended to encompass positions in which a downstream surface of the nozzle tip 300 is disposed within a distance D1 from the burner outlet 134. In an exemplary embodiment, the distance D1 is no more than 40 millimeters.

By extending the lance 200 such that the nozzle tip 300 is at or near the burner outlet 134, the nozzle tip 300 produces a flame front 50 that is wholly within the combustion chamber 18, reducing the likelihood of flame-holding at the nozzle tip 300. Moreover, by positioning the nozzle tip 300 at or near the burner outlet 134, there is a reduction in the likelihood that liquid fuel from the lance 200 will contact the inner surfaces of the mixing cylinder 120, form a coke deposit on the inner surfaces, and lead to flashback of flame from the flame front 50 into the nozzle tip 300.

FIGS. 3-7 illustrate a nozzle tip 300-1, which may be used with the lance 200, according to one aspect provided herein. The nozzle tip 300-1 defines a longitudinal center axis 302 and includes a cartridge 310 coaxial with the longitudinal center axis 302. The cartridge 310 defines a center fuel passage 312, which is in fluid communication with a source of liquid fuel. It should be understood that the liquid fuel source may provide liquid fuel or a mixture of liquid fuel and water.

Figure 7:
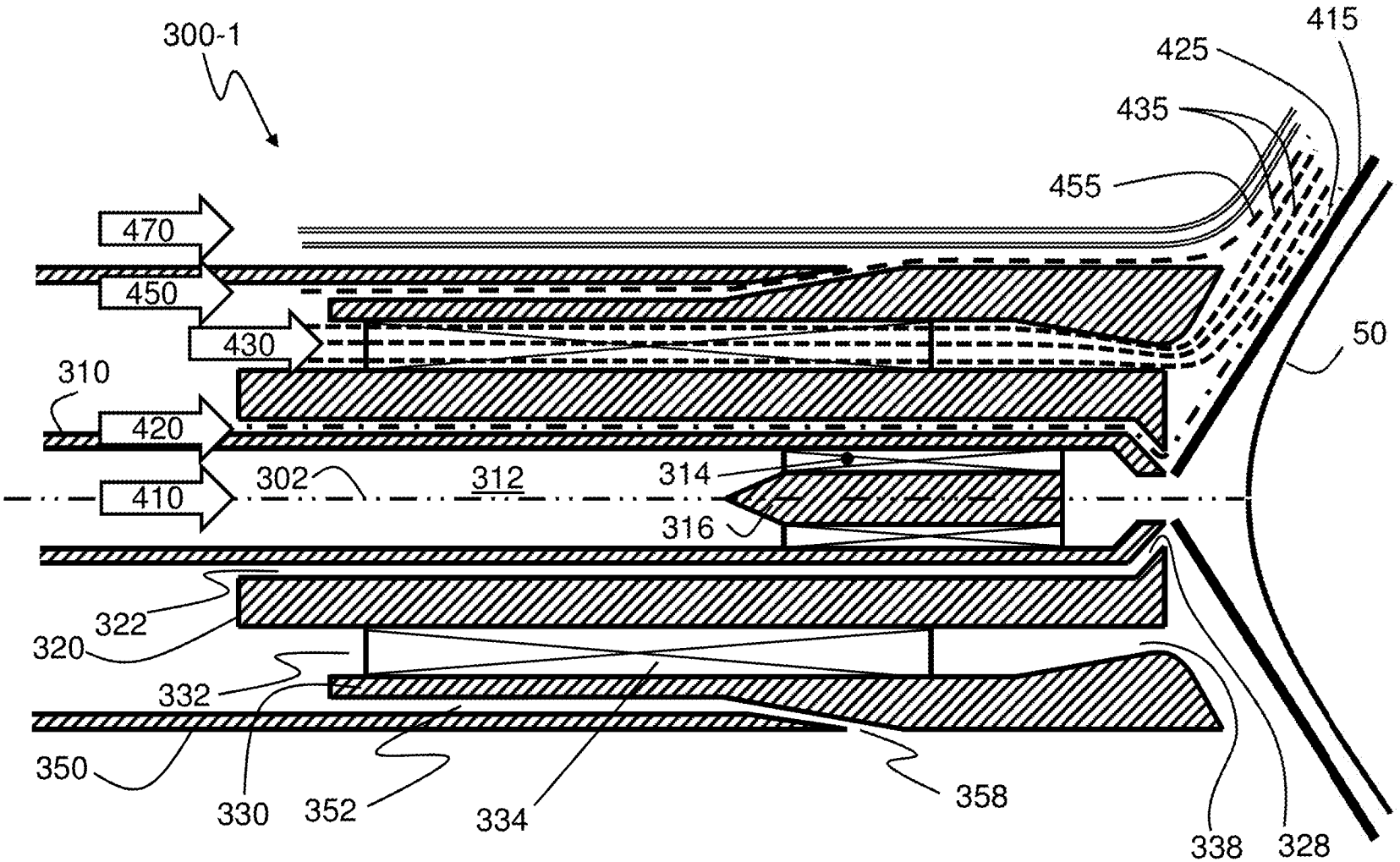
FIG. 7 is a schematic cross-sectional side view of the nozzle tip of FIG. 3, in which various flow paths are illustrated.
Figure 8:
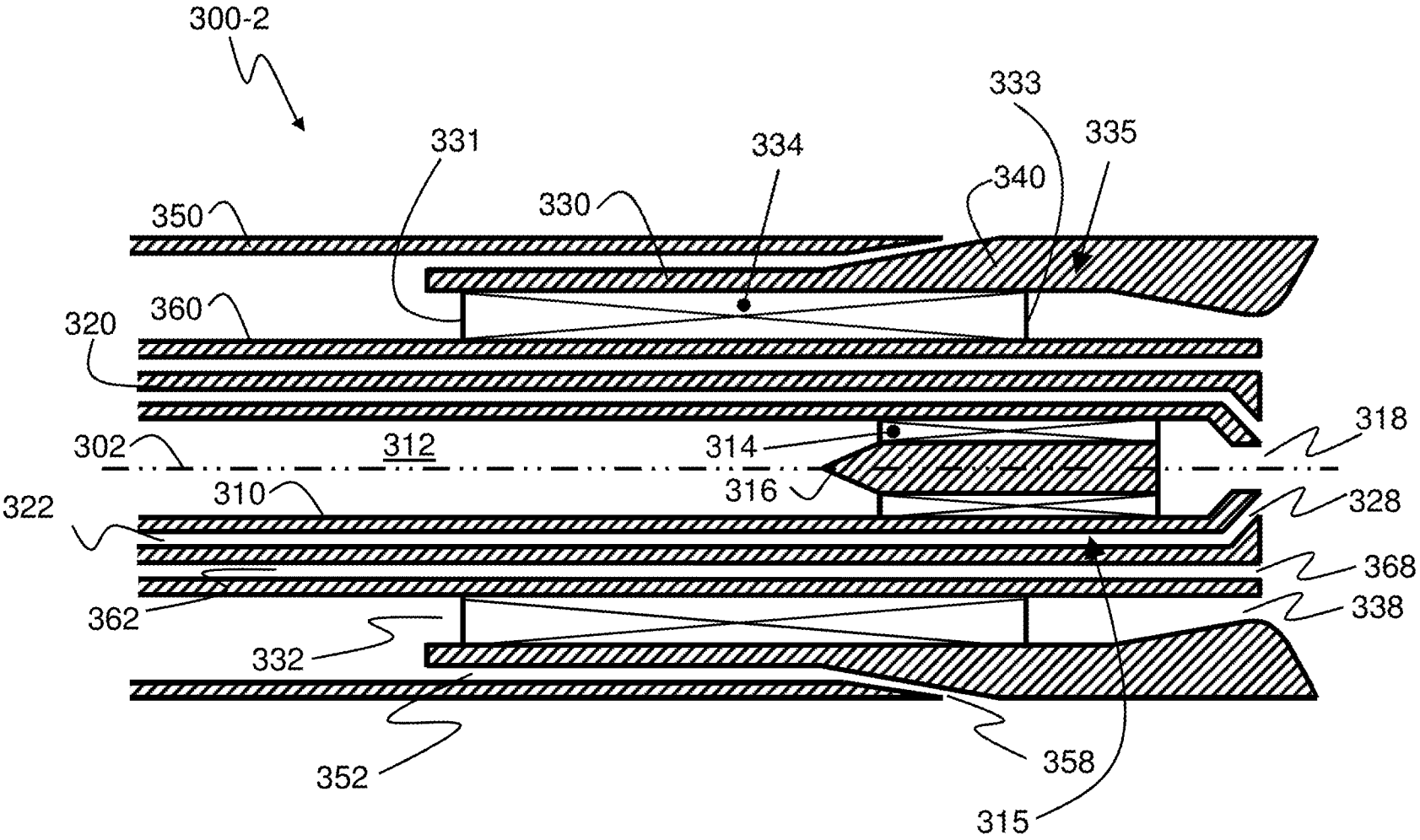
FIG. 8 is a schematic cross-sectional side view of a nozzle tip of the burner lance of FIG. 2, which is designed for liquid fuel operation and/or gaseous fuel operation, according to another aspect provided herein.

Swirl vanes 314 are disposed at the downstream (outlet) end 315 of the cartridge 310 to impart a swirl to the liquid fuel passing through a cartridge outlet 318 and the burner outlet 134. The swirl vanes 314 extend from a central hub 316 that is coaxial with the longitudinal center axis 302 to the inner surface of the cartridge 310. The hub 316 may be tapered at an upstream end to promote the flow of liquid fuel through the swirl vanes 312. The trailing (downstream) edge 313 of the swirl vanes 314 is axially spaced from a converging section 317, such that a swirl cavity 319 is produced between the trailing edge and the cartridge outlet 318. The converging section 317 converges uniformly toward the longitudinal center axis 302, thereby facilitating the creation of a conical spray 415 of fine droplets (as seen in FIG. 7) as the liquid fuel exits the cartridge outlet 318 and the burner outlet 134.

The cartridge 310 is surrounded by a first concentric tube 320, which is coaxial with the longitudinal center axis 302. A first annular fluid passage 322 is defined between an outer surface of the cartridge 310 and an inner surface of the first concentric tube 320. In the exemplary embodiment illustrated, the first annular fluid passage 322 is in fluid communication with a source of air, and the air passing through the first annular fluid passage 322 cools the downstream end 315 of the cartridge 310, which helps to prevent coking within the cartridge 310. Additionally, when the burner 100 is operating only on gaseous fuel, the air flowing through the first annular fluid passage 322 shields the nozzle tip 300-1 from the flame front 50. The inner surface of a downstream end 325 of the first concentric tube 320 includes a converging section 327 that is congruent with the converging section 317 of the cartridge 310 (i.e., converging toward the longitudinal center axis 302 at the same angle). Additionally, as shown in FIG. 7, the air from the first annular fluid passage 322 flows through the converging section 327 and exits through an annular outlet 328 to form an air cone around the conical spray 415 of liquid fuel droplets.

The first concentric tube 320 is surrounded by a second concentric tube 330 of non-uniform, or varying, cross-sectional area. A second annular fluid passage 332 is defined between an outer surface of the first concentric tube 320 and an inner surface of the second concentric tube 330. The upstream end of the second annular fluid passage 332 has a uniform diameter A1 from the inlet of the passage 332 to a throat 336, where the inner surface of the second concentric tube 330 begins to converge toward the longitudinal center axis 302.

A downstream portion 335 of the second concentric tube 320 extends in a downstream (flow) direction from the throat 336, and the inner surface of the downstream portion 335 includes a converging section 337 that tapers uniformly toward an outlet 338 defined between the first concentric tube 320 and the second concentric tube 330. The outlet 338 has a second diameter A2 that is smaller than the uniform upstream diameter A1. The second concentric tube 330 further includes a diverging section 339 between the outlet 338 of the second annular passage 332 and the burner outlet 134.

Swirl vanes 334 are disposed circumferentially within the second annular fluid passage 332. In the illustrated embodiment, the swirl vanes 334 extend radially between the first concentric tube 320 and the second concentric tube 330. Each swirl vane 334 has a leading edge 331 and a trailing edge 333, and the trailing edge 333 is disposed axially upstream of the throat 336. The swirl vanes 334 are illustrated in more detail in FIG. 6.

Air flowing through the second annular fluid passage 332 is swirled by the swirl vanes 334, and the converging and diverging sections 337, 339 of the second concentric tube 330 convey the swirling flow toward the combustion chamber (18) along the contour of the diverging section 339, as shown in FIG. 7. This swirling flow helps to stabilize the flame front 50.

The thickness of the second concentric tube 330 varies from an upstream end to the downstream portion 335. The upstream end of the second concentric tube 330 has a first thickness T1. At the throat 336, the second concentric tube 330 has a second thickness T2, which is greater than the first thickness T1. The outer surface of the second concentric tube 330 diverges from the longitudinal center axis 302 midway along the axial length of the swirl vanes 334 to form an outwardly tapered region 340 of continuously increasing thickness between the first thickness T1 and the second thickness T2. At the outlet 338 of the second annular fluid passage 332, the second concentric tube 330 has a third thickness T3. The second thickness T2 is less than the third thickness T3.

A third concentric tube 350 surrounds the second concentric tube 330, along an upstream portion of the second concentric tube 330. A third annular fluid passage 352 is defined between the outer surface of the second concentric tube 330 and the inner surface of the third concentric tube 350. The third annular fluid passage 352 is in fluid communication with a source of air. The third concentric tube 350 terminates in a plurality of air slots 358, which are defined by struts 359 extending between the second concentric tube 330 and the third concentric tube 350 (as shown in FIG. 5). The air flowing through the third annular fluid passage 352 and the air slots 358 provide a layer of film cooling air along the downstream end of the nozzle tip 300-1.

FIG. 4 illustrates a plan view of the downstream end of the nozzle tip 300-1. The cartridge 310 is located at the center the nozzle tip 300-1 and defines the cartridge outlet 318. The first concentric tube 320 circumferentially surrounds the cartridge 310, and the outlet 328 of the first concentric tube 320 is disposed radially outward of the cartridge outlet 318. The second concentric tube 330 circumferentially surrounds the first concentric tube 320, and the outlet 338 of the second concentric tube 330 is disposed radially outward of the first concentric tube outlet 328.

FIG. 5 provides a perspective view of the downstream end of the nozzle tip 300-1, showing the third concentric tube 350 upstream of the third concentric tube 330. Thus, the outer surface of the nozzle tip 300-1 includes the third concentric tube 350 and the downstream portion 335 of the second concentric tube 330. The struts 359 that connect the third concentric tube 350 to the second concentric tube 330 and that define the air slots 358 are also illustrated.

Figure 6:
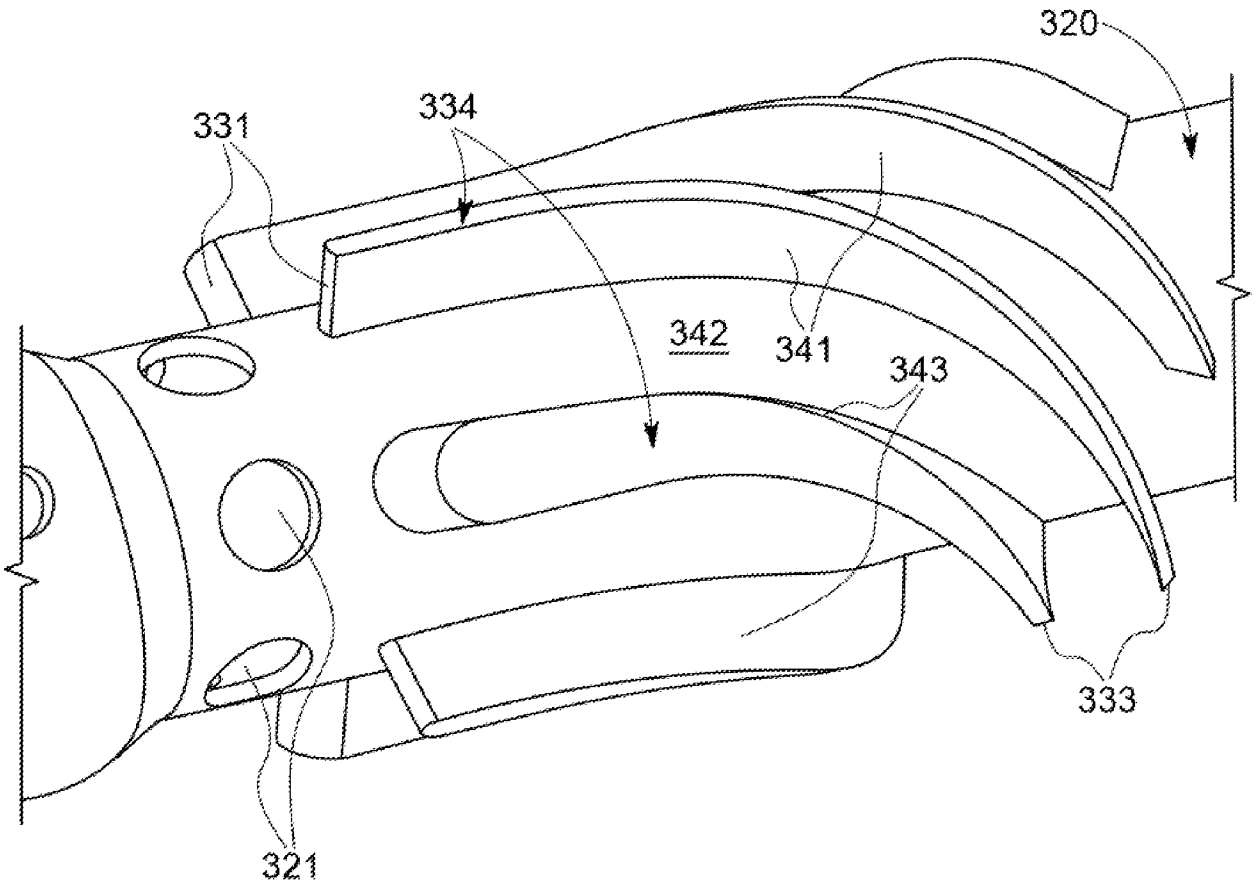
FIG. 6 is a perspective view of a plurality of air swirler vanes, as may be used with the nozzle tips described herein.

FIG. 6 provides a perspective view of the swirl vanes 334, which are configured to swirl the air flowing through the second annular fluid passage 332. Each swirl vane 334 has a curved leading edge 331 and an opposing trailing edge 333, which are connected by a pressure side 341 and a suction side 343. An air channel 342, which curves in a circumferential direction relative to the longitudinal center axis (302), is defined between the pressure side 341 of a first swirl vane 334 and the suction side 343 of a second swirl vane 334.

The swirl vanes 334 extend radially through the second annular fluid passage 332. In the illustrated embodiment, the swirl vanes 334 are shown extending radially outward from the first concentric tube 320. Optionally, the first concentric tube 320 may be provided with a plurality of air ports 321 upstream of the leading edges 331 of the swirl vanes 334. The air ports 321 direct air into the first annular fluid passage 322 to cool the cartridge 310.

FIG. 7 provides a fluid flow diagram through the nozzle tip 300-1. A liquid fuel 410, provided by a liquid fuel source (not shown), flows through the center fuel passage 312 of the center cartridge 310, through the swirl vanes 314 and the converging section 317, and exits through the outlet 318 as a conical spray 415 of liquid fuel droplets (represented by heavy solid lines). A first air stream 420 is represented by a dash-dot line. The first air stream 420, which is in fluid communication with a source of compressed air (not shown), flows through the first annular fluid passage 322 between the cartridge 310 and the first concentric tube 320 and exits through the outlet 328 as a conical air sheath 425 around the conical spray 415. When the burner 100 is operating on gaseous fuel, the conical air sheath 425 shields the nozzle tip 300-1 from the flame front 50.

A second air stream 430 is represented by three dashed lines. The second air stream 430, which is in fluid communication with the same source of compressed air as the first air stream 420, flows through the second annular fluid passage 332, over and between the swirl vanes 334, and exits through the outlet 338 as a swirling air flow 435 that stabilizes the flame front 50. A third air stream 450 is represented by a dashed line.

The third air stream 450, also in fluid communication with the same source of compressed air as the first and second air streams 420, 430, flows through the third annular fluid passage 352 and exits through the air slots 358 to provide a layer of film cooling air 455 around the downstream end of the nozzle tip 300-1. The swirling air flow 435 and the film cooling air 455 flow into the main burner flow 470 (represented by two double lines).

FIGS. 8-11 illustrate a nozzle tip 300-2, which may be used with the lance 200, according to another aspect provided herein. The nozzle tip 300-2 includes many common features with the nozzle tip 300-1 and, as such, the discussion above with respect to those features is not reproduced here.

With simultaneous reference to FIGS. 8 through 11, the nozzle tip 300-2 includes a fourth concentric tube 360 that circumferentially surrounds the first concentric tube 320 and that is positioned between the first concentric tube 320 and the second concentric tube 330. In this embodiment, the air swirl vanes 334 located in the second annular fluid passage 332 extend between the second concentric tube 320 and the fourth concentric tube 360 (instead of the first concentric tube 310).

A fourth annular fluid passage 362 is defined between the outer surface of the first concentric tube 320 and the inner surface of the fourth concentric tube 360. The fourth annular fluid passage 362 is in fluid communication with a source of gaseous fuel, thereby enabling the nozzle tip 300-2 for so-called "dual fuel" operation (operating on either liquid fuel or gaseous fuel). The fourth concentric tube 360 terminates in a plurality of fuel delivery slots 368, which are defined by struts 369 extending between the first concentric tube 320 and the fourth concentric tube 360 (as shown in FIGS. 9 and 10). The gaseous fuel flowing through the fourth annular fluid passage 362 and the fuel delivery slots 368 deliver gaseous fuel in an axial direction, consistent with the longitudinal center axis 302 of the lance 200, into the flame front 50.

FIG. 11 provides a fluid flow diagram through the nozzle tip 300-2. The liquid fuel 410, provided by a liquid fuel source (not shown), flows through the center fuel passage 312 of the center cartridge 310, through the swirl vanes 314 and the converging section 317, and exits through the outlet 318 as a conical spray 415 of liquid fuel droplets (represented by heavy solid lines). The first air stream 420 is represented by a dash-dot line. The first air stream 420, which is in fluid communication with a source of compressed air (not shown), flows through the first annular fluid passage 322 between the cartridge 310 and the first concentric tube 320 and exits through the outlet 328 as a conical air sheath 425 around the conical spray 415.

A gaseous fuel stream 460 (represented by arrows) is in fluid communication with a source of gaseous fuel (not shown). The gaseous fuel stream 460 flows through the fourth annular fluid passage 362 and exits in an axial direction, relative to the longitudinal center axis 302, from the fuel delivery slots 368 as a gaseous fuel flow 465.

The second air stream 430 is represented by three dashed lines. The second air stream 430, which is in fluid communication with the same source of compressed air as the first air stream 420, flows through the second annular fluid passage 332, over and between the swirl vanes 334, and exits through the outlet 338 as a swirling air flow 435 that stabilizes the flame front 50. The third air stream 450 is represented by a dashed line.

The third air stream 450, also in fluid communication with the same source of compressed air as the first and second air streams 420, 430, flows through the third annular fluid passage 352 and exits through the air slots 358 to provide a layer of film cooling air 455 around the downstream end of the nozzle tip 300-2. The gaseous fuel flow 465, the swirling air flow 435, and the film cooling air 455 flow into the main burner flow 470 (represented by two double lines).

FIGS. 12 and 13 illustrate an alternate embodiment of the nozzle tip 300-2. In nozzle tip 300-3, the fourth concentric tube 360 is closed at the downstream end (e.g., the fourth concentric tube 360 may be integrally formed with the first concentric tube 320). Instead of fuel delivery slots 368 defined by struts 369, the closed end of the fourth concentric tube 360 is provided with a plurality of fuel ports 361. The gaseous fuel stream 460 flowing through the fourth annular fluid passage 362 defined between the first concentric tube 320 and the fourth concentric tube 360 exits through the fuel ports 361. The fuel ports 361 may be normal to the surface of the downstream end or may be angled to induce swirl to the gaseous fuel stream 465.

Figure 14:
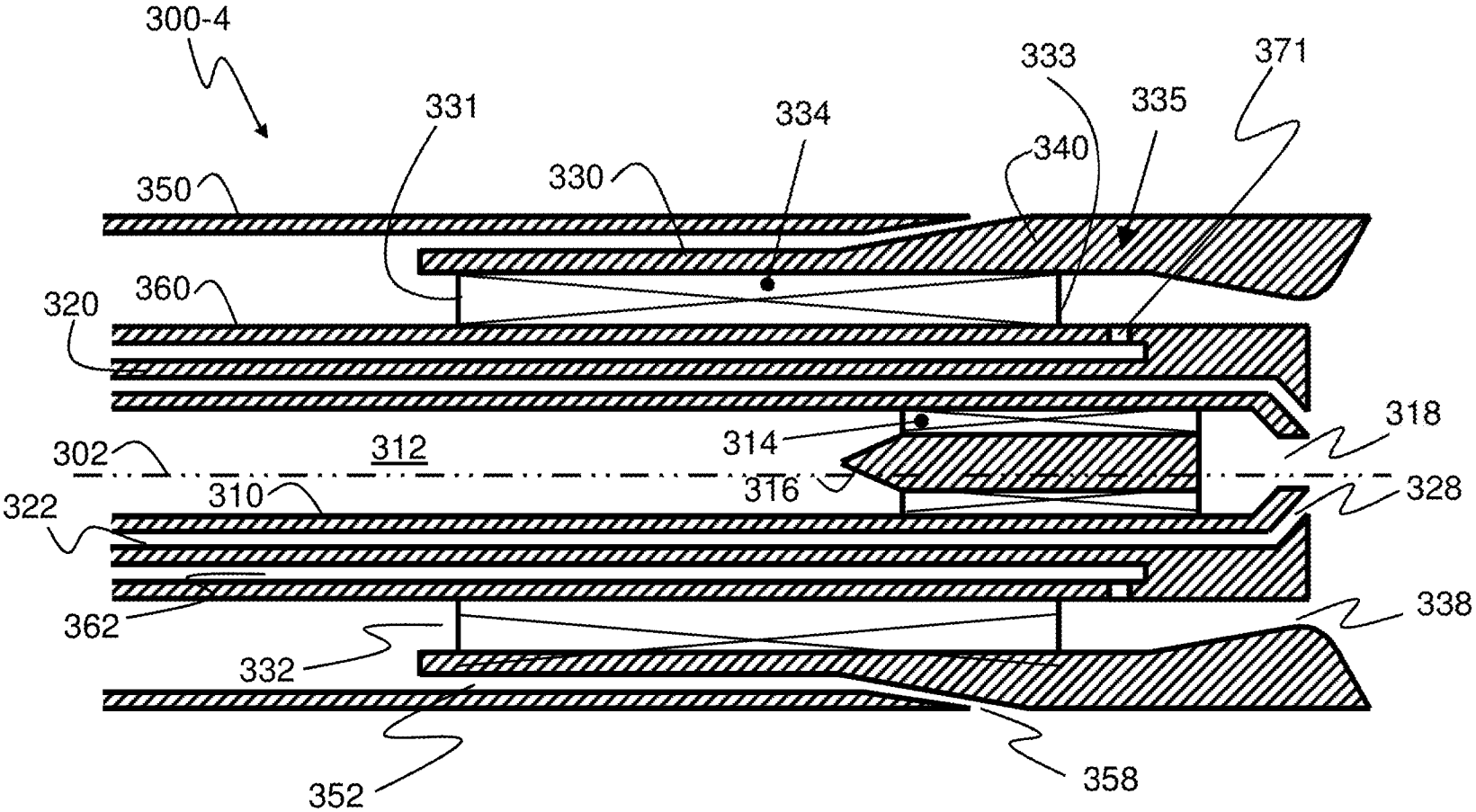
FIG. 14 is a schematic cross-sectional side view of a nozzle tip of the burner lance of FIG. 2, which is design for liquid fuel operation and/or partially premixed gaseous fuel operation, according to yet another aspect provided herein.
Figure 15:
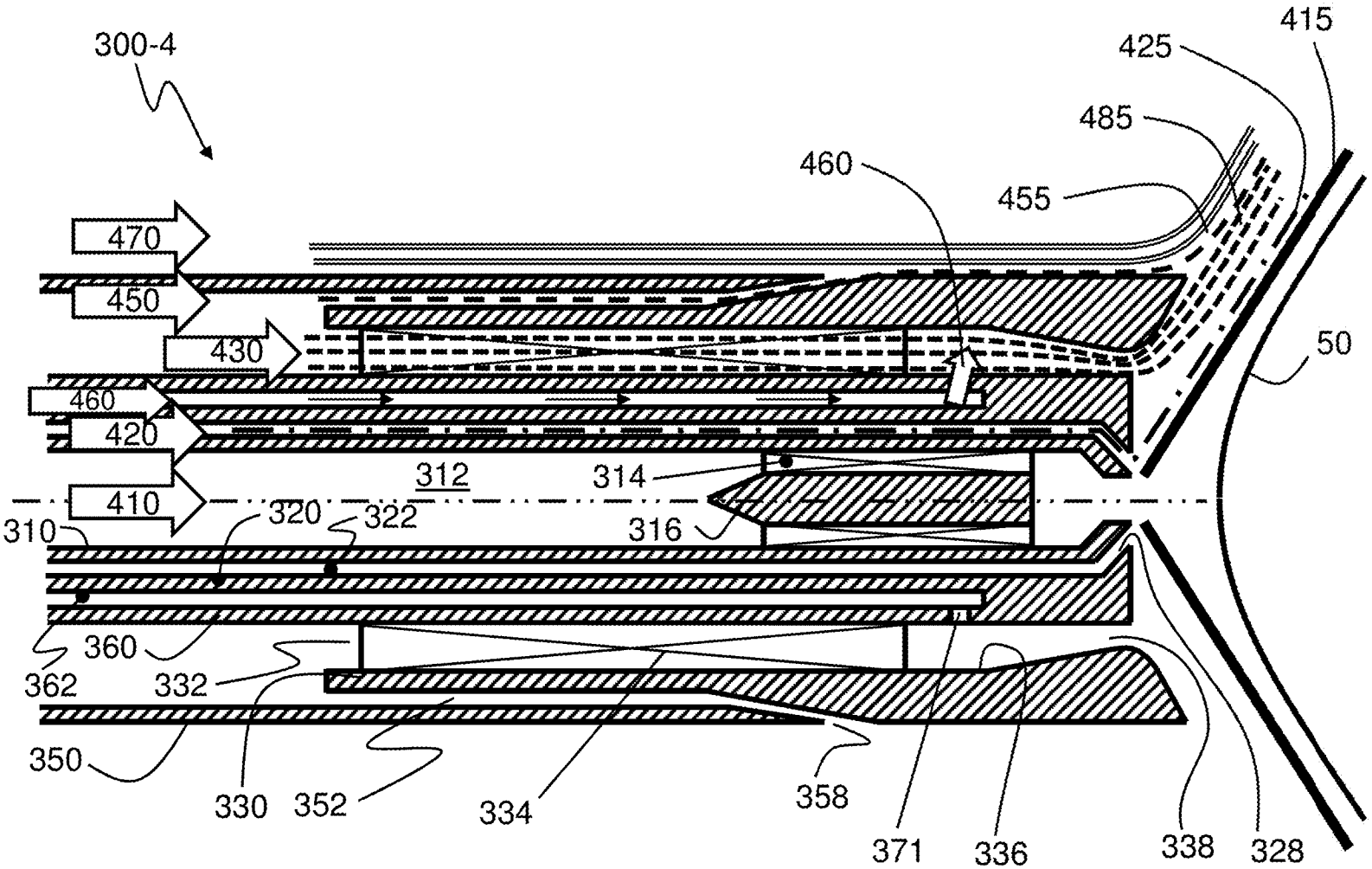
FIG. 15 is a schematic cross-sectional side view of the nozzle tip of FIG. 14, in which various flow paths are illustrated.

FIGS. 14 and 15 schematically illustrate a nozzle tip 300-4, which may be used with the burner lance of FIG. 2 and which is designed for liquid fuel operation and/or partially premixed gaseous fuel operation, according to yet another aspect provided herein. In nozzle tip 300-4, a plurality of fuel ports 371 are defined through the fourth concentric tube 360, such that the fuel flows radially outward (away from the longitudinal center axis 302) and into the second annular fluid passage 332. The fuel ports 371 may be axially aligned with, or slightly upstream, of the throat 336 of the second annular fluid passage 332 to promote the mixing of the fuel with the air flow 430 passing over the swirl vanes 334.

As shown in FIG. 15, the liquid fuel 410, provided by a liquid fuel source (not shown), flows through the center fuel passage 312 of the center cartridge 310, through the swirl vanes 314 and the converging section 317, and exits through the outlet 318 as a conical spray 415 of liquid fuel droplets (represented by heavy solid lines). The first air stream 420 is represented by a dash-dot line. The first air stream 420, which is in fluid communication with a source of compressed air (not shown), flows through the first annular fluid passage 322 between the cartridge 310 and the first concentric tube 320 and exits through the outlet 328 as a conical air sheath 425 around the conical spray 415.

A gaseous fuel stream 460 (represented by arrows) is in fluid communication with a source of gaseous fuel (not shown). The gaseous fuel stream 460 flows through the fourth annular fluid passage 362 and exits in a radial direction, relative to the longitudinal center axis 302, from the fuel ports 371 into the second annular fluid passage 332.

The second air stream 430 is represented by three dashed lines. The second air stream 430, which is in fluid communication with the same source of compressed air as the first air stream 420, flows through the second annular fluid passage 332 over and between the swirl vanes 334. The gaseous fuel from the fuel ports 371 partially mixes with the swirling air flow, and the partial premixture of fuel and air exits through the outlet 338 as a swirling premixture flow 485 that stabilizes the flame front 50.

The third air stream 450 is represented by a dashed line. The third air stream 450, also in fluid communication with the same source of compressed air as the first and second air streams 420, 430, flows through the third annular fluid passage 352 and exits through the air slots 358 to provide a layer of film cooling air 455 around the downstream end of the nozzle tip 300-4. The swirling premixture flow 485 and the film cooling air 455 flow into the main burner flow 470 (represented by two double lines).

FIGS. 16 and 17 schematically illustrate a nozzle tip 300-5, which may be used with the burner lance of FIG. 2 and which is designed for liquid fuel operation and/or fully premixed gaseous fuel operation, according to yet another aspect provided herein.

In nozzle tip 300-5, a plurality of fuel ports 381 are defined through the fourth concentric tube 360, such that the fuel flows radially outward (away from the longitudinal center axis 302) and into the second annular fluid passage 332 between the swirl vanes 334. The fuel ports 371 may be axially disposed between the leading edge 331 and the trailing edge 333 of the swirl vanes 334 to promote even better mixing of the fuel with the air flow 430 passing over the swirl vanes 334.

As shown in FIG. 17, the liquid fuel 410, provided by a liquid fuel source (not shown), flows through the center fuel passage 312 of the center cartridge 310, through the swirl vanes 314 and the converging section 317, and exits through the outlet 318 as a conical spray 415 of liquid fuel droplets (represented by heavy solid lines). The first air stream 420 is represented by a dash-dot line. The first air stream 420, which is in fluid communication with a source of compressed air (not shown), flows through the first annular fluid passage 322 between the cartridge 310 and the first concentric tube 320 and exits through the outlet 328 as a conical air sheath 425 around the conical spray 415.

The gaseous fuel stream 460 (represented by arrows) is in fluid communication with a source of gaseous fuel (not shown). The gaseous fuel stream 460 flows through the fourth annular fluid passage 362 and exits in a radial direction, relative to the longitudinal center axis 302, from the fuel ports 381 into the second annular fluid passage 332 between the swirl vanes 334.

The second air stream 430 is represented by three dashed lines. The second air stream 430, which is in fluid communication with the same source of compressed air as the first air stream 420, flows through the second annular fluid passage 332 over and between the swirl vanes 334. The gaseous fuel from the fuel ports 381 fully mixes with the swirling air flow, and the complete premixture of fuel and air exits through the outlet 338 as a swirling premixture flow 495 that stabilizes the flame front 50.

The third air stream 450 is represented by a dashed line. The third air stream 450, also in fluid communication with the same source of compressed air as the first and second air streams 420, 430, flows through the third annular fluid passage 352 and exits through the air slots 358 to provide a layer of film cooling air 455 around the downstream end of the nozzle tip 300-5. The swirling premixture flow 495 and the film cooling air 455 flow into the main burner flow 470 (represented by two double lines).

As will be appreciated, manufacturing a nozzle tip (e.g., tip 300-1) with its converging sections 317, 327, and 337 and with tubes of non-uniform cross-sectional area can be challenging using conventional manufacturing techniques. For this reason, although not required, it may be desirable to additively manufacture the nozzle tip 300.

Additive manufacturing processes form a three-dimensional object by forming successive layers of material, typically under computer control. Three-dimensional (3D) printing is an additive manufacturing technique enabling creation of an article by forming successive layers of material under computer control to create a 3D structure. The process typically includes heating a layer of powder of the material to melt or sinter the powder to the previously-placed layers to form the article layer by layer. A 3D printer lays down powder material, and a focused energy source, such as a laser or an electron beam, melts or sinters that powder material in certain predetermined locations based on a model from a computer-aided design (CAD) file.

Additive manufacturing methods include direct metal laser melting (DMLM), direct metal laser sintering (DMLS), selective laser melting (SLM), selective laser sintering (SLS), and electron beam melting (EBM). Once one layer is melted or sintered and formed, the 3D printer repeats the process by placing and melting or sintering additional layers of material on top of the first layer or where otherwise instructed, one layer at a time, until the entire article is fabricated. Such 3D printing techniques may be accomplished by powder bed processing or other methods of powder processing.

Exemplary embodiments of a combustor burner having an elongate fuel lance with an inventive nozzle tip and methods of using the same are described above in detail. The methods and systems described herein are not limited to the specific embodiments described herein, but rather, components of the methods and systems may be utilized independently and separately from other components described herein. For example, the methods and systems described herein may have other applications not limited to practice with turbine assemblies, as described herein. Rather, the methods and systems described herein can be implemented and utilized in connection with various other industries.

While the technical advancements have been described in terms of various specific embodiments, those skilled in the art will recognize that the technical advancements can be practiced with modification within the spirit and scope of the claims.

What is claimed is:

1. A burner for a combustor, the burner comprising:

(a) a swirl generator enclosing a burner interior on an inlet side, the swirl generator comprising at least one tangential air inlet relative to a longitudinal center axis of the burner;

(b) a mixing chamber enclosing the burner interior on an outlet side, the mixing chamber defining a burner outlet fluidly connecting the burner interior with a combustion chamber of the combustor;

(c) a lance arranged coaxially with the longitudinal center axis of the burner, the lance comprising a nozzle tip at or near the burner outlet, the nozzle tip being configured and arranged to introduce fuel into the combustion chamber;

wherein the nozzle tip comprises:

a cartridge defining a center fuel passage;

a first plurality of swirl vanes disposed within the center fuel passage at an outlet end of the nozzle tip;

a first concentric tube surrounding the center fuel passage and defining a first annular fluid passage therebetween;

a second concentric tube surrounding the first concentric tube and defining a second annular fluid passage;

a second plurality of swirl vanes disposed in the second annular fluid passage;

a third concentric tube surrounding an upstream portion of the second concentric tube and defining a third annular fluid passage therebetween, the third concentric tube defining a plurality of air channels in fluid communication with the third annular fluid passage, the plurality of air channels being disposed between a downstream end of the third concentric tube and the second concentric tube; and a fourth concentric tube disposed between the first concentric tube and the second concentric tube, wherein a fourth annular fluid passage is defined between the first concentric tube and the fourth concentric tube.

2. The burner of claim 1, wherein the center fuel passage is fluidly coupled to a source of liquid fuel.

3. The burner of claim 1, wherein the cartridge comprises a downstream end converging toward the longitudinal center axis, the downstream end producing a conical spray of fuel.

4. The burner of claim 3, wherein the first concentric tube comprises a downstream end converging toward the longitudinal center axis, and wherein the downstream end of the first concentric tube is concentric with the downstream end of the cartridge.

5. The burner of claim 4, wherein the downstream end of the first concentric tube produces a conical sheath of air radially outward of the conical spray of fuel.

6. The burner of claim 1, wherein the first annular fluid passage, the second annular fluid passage, and the third annular fluid passage are each in fluid communication with a source of air.

7. The burner of claim 1, wherein the fourth annular fluid passage is in fluid communication with a source of gaseous fuel.

8. The burner of claim 1, wherein the fourth annular fluid passage terminates in a plurality of outlets defined in an axial direction relative to the longitudinal center axis.

9. The burner of claim 8, wherein the plurality of outlets are slot-shaped outlets defined by a plurality of struts extending between the first 11 concentric tube and the fourth concentric tube.

10. The burner of claim 1, wherein the fourth annular fluid passage comprises a plurality of outlets defined in a radial direction through the fourth concentric tube; wherein the plurality of outlets is in fluid communication with the second annular fluid passage.

11. The burner of claim 10, wherein the plurality of outlets is disposed downstream of the second plurality of swirl vanes in the second annular fluid passage.

12. The burner of claim 10, wherein the plurality of outlets is disposed between the second plurality of swirl vanes of the second annular fluid passage.

13. A burner for a combustor, the burner comprising:

(a) a swirl generator enclosing a burner interior on an inlet side, the swirl generator comprising at least one tangential air inlet relative to a longitudinal center axis of the burner;

(b) a mixing chamber enclosing the burner interior on an outlet side, the mixing chamber defining a burner outlet fluidly connecting the burner interior with a combustion chamber of the combustor;

(c) a lance arranged coaxially with the longitudinal center axis of the burner, the lance comprising a nozzle tip at or near the burner outlet, the nozzle tip being configured and arranged to introduce fuel into the combustion chamber;

wherein the nozzle tip comprises:

a cartridge defining a center fuel passage;

a first plurality of swirl vanes disposed within the center fuel passage at an outlet end of the nozzle tip;

a first concentric tube surrounding the center fuel passage and defining a first annular fluid passage therebetween;

a second concentric tube surrounding the first concentric tube and defining a second annular fluid passage, the second concentric tube having a non-uniform thickness from an inlet end to an outlet end;

a second plurality of swirl vanes disposed in the second annular fluid passage;

a third concentric tube surrounding an upstream portion of the second concentric tube and defining a third annular fluid passage therebetween, the third concentric tube defining a plurality of air channels in fluid communication with the third annular fluid passage, the plurality of air channels being disposed between a downstream end of the third concentric tube and the second concentric tube; and a fourth concentric tube disposed between the first concentric tube and the second concentric tube, wherein a fourth annular fluid passage is defined between the first concentric tube and the fourth concentric tube.

14. The burner of claim 13, wherein the cartridge comprises a downstream end converging toward the longitudinal center axis, the downstream end producing a conical spray of fuel.

15. The burner of claim 14, wherein the first concentric tube comprises a downstream end converging toward the longitudinal center axis, and wherein the downstream end of the first concentric tube is concentric with the downstream end of the cartridge.

16. The burner of claim 15, wherein the downstream end of the first concentric tube produces a conical sheath of air radially outward of the conical spray of fuel.

17. The burner of claim 13, wherein the center fuel passage is in fluid communication with a source of liquid fuel; wherein the first annular fluid passage, the second annular fluid passage, and the third annular fluid passage are each in fluid communication with a source of air; and wherein the fourth annular fluid passage is in fluid communication with a source of gaseous fuel.

* * * * *